US005085912A

United States Patent [19]

Algiere

[11] Patent Number: 5,085,912

[45] Date of Patent: Feb. 4, 1992

[54] WEAR RESISTANT FLOOR COVERING

[76] Inventor: Louis Algiere, 103-17 Metropolitan Ave., Forest Hills, N.Y. 11375

[21] Appl. No.: 442,665

[22] Filed: Nov. 29, 1989

[51] Int. Cl.[5] ..... B32B 3/10

[52] U.S. Cl. ..... 428/67; 428/95; 428/120; 428/138; 428/212; 404/19; 404/21; 404/32; 404/44

[58] Field of Search ..... 428/67, 95, 120, 138, 428/212; 404/19, 32, 44, 21

[56] References Cited

U.S. PATENT DOCUMENTS 2,323,461 7/1943 Donelson ..... 404/32

FOREIGN PATENT DOCUMENTS 2231787 1/1974 Fed. Rep. of Germany ..... 404/32

*Primary Examiner*—Alexander S. Thomas

*Attorney, Agent, or Firm*—Hedman, Gibson, Costigan & Hoare

[57] ABSTRACT

Wear resistant floor coverings have a plurality of stud-like inserts which are flush with the underside of the floor covering to prevent against wear and slippage.

10 Claims, 3 Drawing Sheets

WEAR RESISTANT FLOOR COVERING

FIELD OF THE INVENTION

This invention relates to floor coverings and more particularly to floor coverings which are resistant to wear and slippage. Most specifically, this invention relates to floor coverings having stud-like inserts which provide the floor covering with protection against wear and slippage.

BACKGROUND OF THE INVENTION

Floor coverings are used in a number of settings and are available in a variety of types. Typical floor coverings include linoleum, tile carpeting and other sheet type materials. The type of floor covering chosen will depend upon many factors, including where the floor covering is to be placed, the volume of traffic that will travel over the floor covering as well as the aesthetic value desired.

Carpeting and other similar coverings are used in the home and may last for many years. However, after only a short period of time, in heavy traffic areas, such as hallways and stairs, or pivot areas (location of changes in direction requiring a pivot of a foot), the carpet will begin to show wear before other areas, resulting in an uneven look in the carpet.

In offices, public areas and other heavy traffic areas, floor coverings need to be even more resistant to wear. Often, the floor coverings will begin to show wear or traffic patterns after only a short period of time. Stairways, hallways and similar passageways in these locations are even more susceptible to wear.

In addition, floor coverings used in heavy traffic areas should be slip-resistant. It is important that all portions of the floor covering be adhered to the subfloor so as to resist the tendency to creep while people are walking over the floor covering.

In the past, resilient type floor tiles have been used to meet these requirements. These tiles have been provided with a number of steel studs to prevent against wear. Typically, the studs were inserted through the tile from the bottom (or underside) until the stud was flush with the top (or topside) of the tile. The tile was then laid over the floor with the studs rigidly set in place. However, the steel studs were not flush with the underside of the tile. When the tiles were installed, the steel studs prevented the underside of the tile from being placed flush with the floor. After some time, the repeated volumes of traffic would cause tile to loosen from the floor and eventually dislodge causing a safety hazard, as well as an unpleasing appearance.

Further, due to the lack of ability of the tile to stay intact, use of tiles having steel studs has been further restricted to low traffic areas such as elevators and building entrances.

Still further, the appearance of the steel studs has limited their use to rubber or vinyl floor tiles. Use of such tiles has subsequently been restricted to commercial installations.

BRIEF DESCRIPTION OF THE INVENTION

As a result of the requirements of floor coverings, it is necessary for floor coverings to be resistant to wear and also provide decorative value to the installation. In addition, floor coverings are to be constructed so as to prevent against slippage while persons walk on the floor covering. It is also required that the installed floor coverings be securely attached to the floor being covered.

It is therefore an object of the present invention to provide a floor covering that is resistant to wear.

It is further an object of the present invention to provide a floor covering that will provide a permanent installation.

It is further an object of the present invention to provide a floor covering that will remain in place and not tend to slip while persons walk on the floor covering.

Still a further object of the present invention is to provide a floor covering that will prevent against uneven wear.

Still a further object of the present invention is to provide a floor covering that has aesthetic as well as functional value.

Accordingly, the present invention is directed to a floor covering which is provided with stud-like inserts. Specifically, the preferred embodiment of the floor covering comprises a plurality of stud-like inserts which, when inserted into the floor covering, are flush with at least the underside of the floor covering.

BRIEF DESCRIPTION OF THE DRAWINGS

The invention will be better understood by way of example with reference to the accompanying drawings in which.

DESCRIPTION OF THE PREFERRED EMBODIMENT

Figure 1:
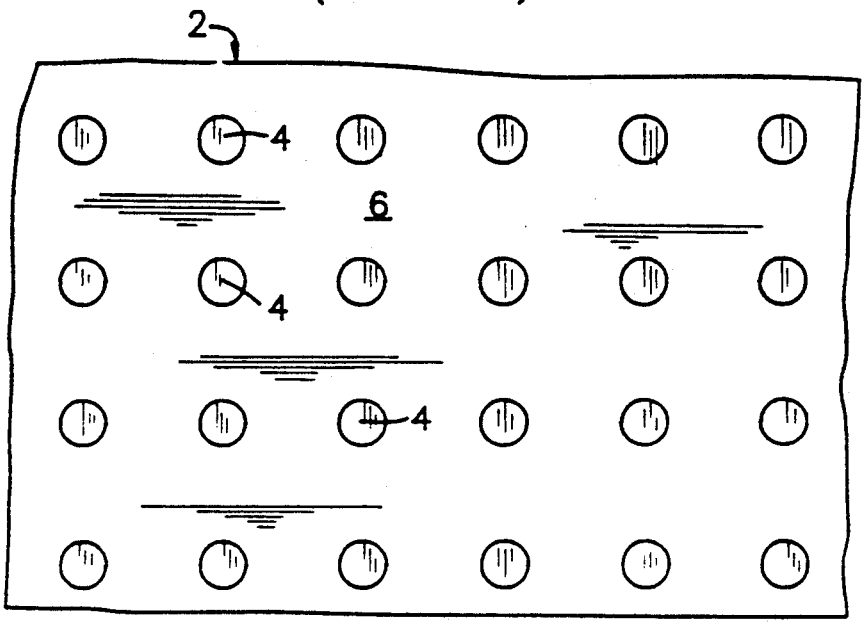
FIG. 1 (PRIOR ART)
FIG. 1 is a top plan view of a rubber floor tile known in the prior art.
Figure 2:
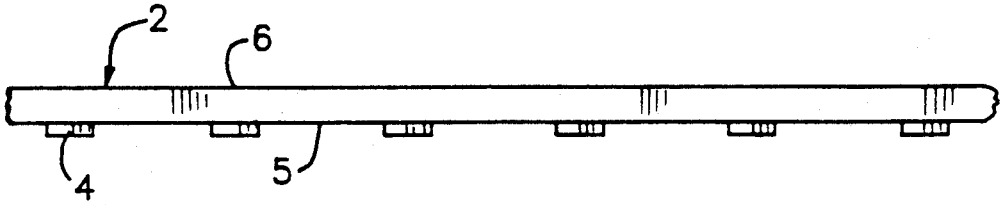
FIG. 2 (PRIOR ART)
FIG. 2 is a side elevational view of the rubber floor tile of FIG. 1.

The floor covering of FIGS. 1 and 2 is of a rubber tile (2) known in the prior art. The tile (2) has been provided with steel studs (4) which can be seen from the top surface (6) of the tile (2). The studs (4) are flush with the top surface (6) of the tile (2). As seen in FIG. 2, the studs (4) can be seen from the underside (5) of the tile. However, the studs (4) extend below the underside (5) of the tile (2) in a manner so as the studs (4) are not flush with the underside (5), thus causing the tile (2) to loosen and dislodge after some time.

Figure 3:
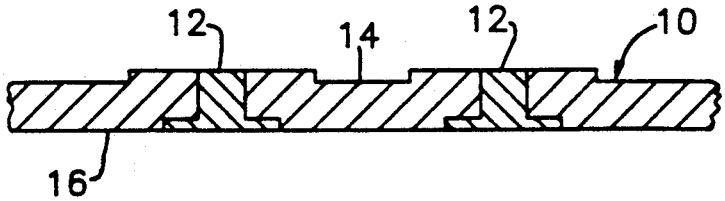
FIG. 3 is a cross-sectional view of a floor covering of the present invention.
Figure 4:
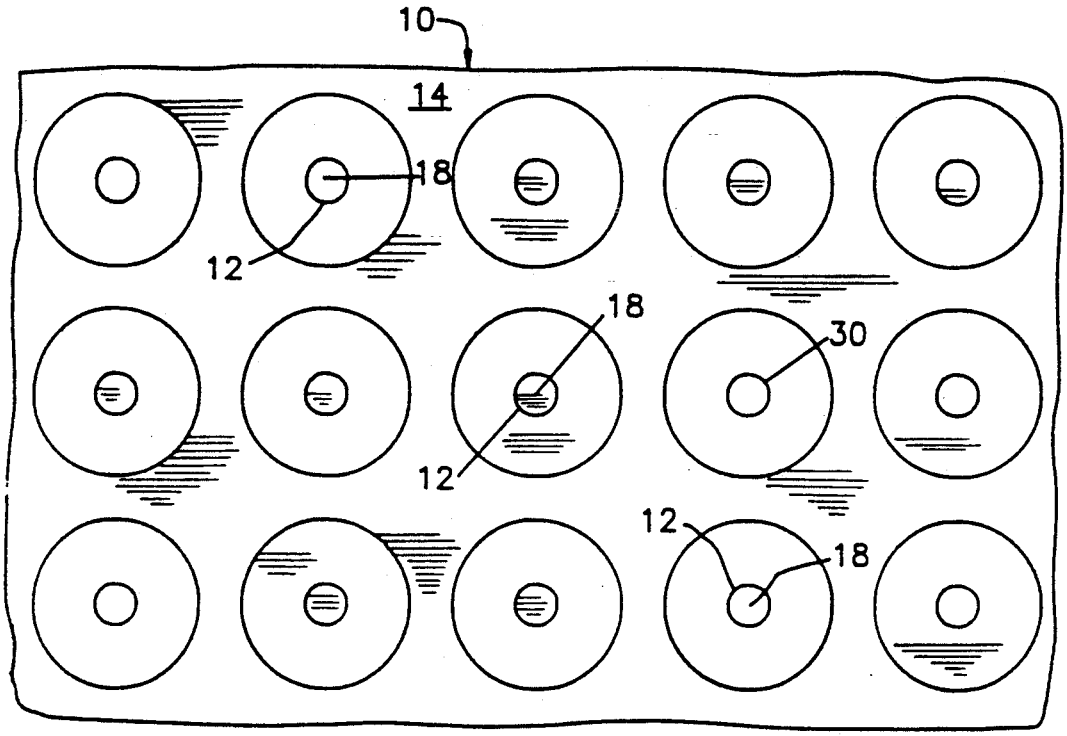
FIG. 4 is a top plan view of a floor covering of the present invention.
Figure 5:
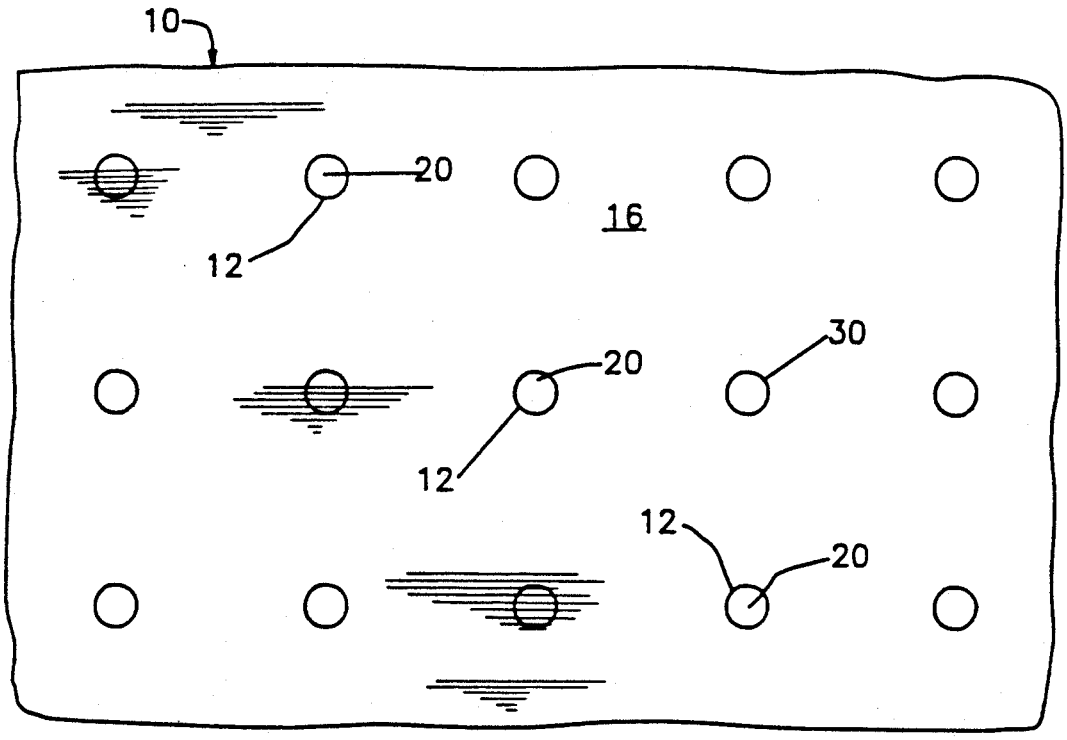
FIG. 5 is a bottom plan view of a floor covering of the present invention.

The floor covering of the present invention seen in FIGS. 3, 4 and 5 is a rubber floor tile (10). The tile (10) has a topside (14) and an underside (16). The tile (10) is provided with a plurality of stud-like inserts (12). An insert (12) is depicted in FIG. 6.

Figure 6:
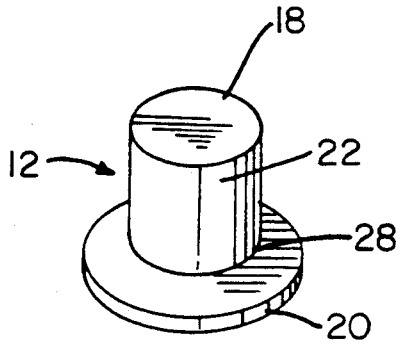
FIG. 6 is a perspective view of an insert of the present invention.

The insert (12) of FIG. 6 is a stud-like insert (12) having an upper surface (18), a bottom surface (20), a collar (28) and a stem (22).

The insert (12) is sized so that after the insert (12) is secured into the tile (10) or other floor covering. The bottom surface (20) of the insert (12) is flush with the underside (16) of the tile (10) as seen in FIGS. 3 and 5. The upper surface (18) of the insert (12) can also be flush with the topside (14) of the tile (10) as seen in FIG. 4.

Each insert (12) is placed into the tile (10) or other floor covering by hand. An opening (30) as seen in FIGS. 4 and 5 is created in the tile (10) with a hand-held tool. Each opening (30) is sized so that the circumference of the opening (30) is the same as the circumference of the stem (22) of an insert. The opening (30) is also configured so that the circumference of the opening (30) at the underside (16) of the tile (10) is the same as the circumference at the bottom surface (20) of the insert (12). This allows the insert (12) to be flush with the underside (16) of the tile (10).

It is important to have the bottom surface (20) of the insert (12) flush with the underside (16) of the tile (10). This allows the underside (16) to be fully coated with a proper adhesive. It has been found that application of the tile (10) having inserts (12) flush with the underside (16) to a floor to be covered will eliminate substantially any bounce in the installed tile and will provide a secure installation.

The placement of the inserts (12) in the tile (10) also allow for the upper surface (18) of the insert (12) to form various decorative patterns in the topside (14) of the tile (10).

Practice has shown that the maximum benefits are achieved when the number of inserts (12) secured into the tile (10) is about 144 inserts (12) per square foot. The insert (12) should be placed about 1" from the edges of the tile (10) and there should be at least about 1" between each insert (12) but no more than about 2.5" apart. Preferred placement of the inserts (12) in the tile (10) is in a substantially parallel configuration.

The insert of the present invention can be of a variety of shapes and made from a selection of durable material. For example, inserts (not shown) formed in accordance with the present invention can be substantially circular or substantially rectangular in shape. The ability of the insert to have a number of different configurations contributes not only to the durability of the floor covering as well as the decorative value of the floor covering. The inserts can be made of steel, aluminum, thermoformed plastic or other superplastic material.

Practice has shown that the upper surface (18) of the insert (12) should have a diameter of about 0.25". The diameter of the bottom surface (20) should be about 0.5".

The floor covering of the present invention covers the full spectrum of floor coverings. Floor coverings include carpeting, linoleum and tile and other types of coverings for floors which have resilient properties.

Figure 7:
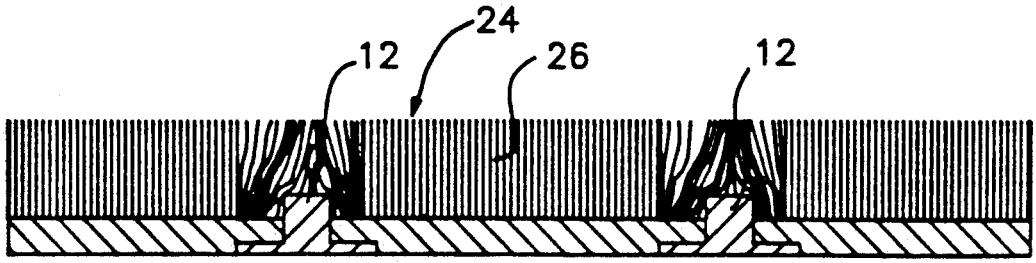
FIG. 7 is a cross-sectional view of a carpet floor covering of the present invention.

In another embodiment of the present invention, the floor covering can be carpeting (24), as shown in FIG. 7. The insert (12) will be sized so as to be sufficiently long as to penetrate deeply enough into the pile (26) of the carpet (24) but not be seen. This will allow the traffic traveling over the carpet (24) to place its footing on the upper surface (18) of the inserts (12) and not the carpet (24).

I claim:

1. A floor covering comprising a flooring material, having a top side and an underside, and a plurality of durable inserts, each of said inserts having an upper surface, a bottom surface having a surface area larger than the upper surface, a collar and a stem, wherein said inserts are sized so that the bottom surface of the insert is flush with at least the underside of the flooring material and the height of the insert is not less than the height of the flooring material.

2. A floor covering as in claim 1, wherein said inserts are sized so as to be flush with the underside and topside of the flooring material.

3. A floor covering as in claim 2, wherein said flooring material is a rubber tile.

4. A floor covering as claim 1, wherein said flooring material is carpet.

5. A floor covering as in claim 1, wherein the insert is made from the group comprising thermoformed plastic or superplastic material.

6. A floor covering as in claim 1, wherein the insert is steel.

7. A floor covering as in claim 1, wherein the insert is aluminum.

8. A floor covering as in claim 1, wherein the upper surface, collar, stem and bottom surface of said insert are substantially rectangular in shape.

9. A floor covering as in claim 1, wherein the upper surface, collar, stem and bottom surface of said insert are substantially circular in shape.

10. A floor covering as in claim 1, wherein the preferred placement of said inserts in the flooring material is in a substantially parallel manner.

* * * * *